US006116873A

United States Patent [19]

Wang

[11] Patent Number: 6,116,873

[45] Date of Patent: Sep. 12, 2000

[54] FLOOR PUMP

[76] Inventor: Lopin Wang, 16F-2, No. 17, Lane 52, Sec. 3, Je-He Road, Taichung, Taiwan

[21] Appl. No.: 09/139,746

[22] Filed: Aug. 25, 1998

[30] Foreign Application Priority Data

Sep. 1, 1997 [TW] Taiwan ..... 86214909

[51] Int. Cl.[7] ..... F04B 53/12

[52] U.S. Cl. ..... 417/550

[58] Field of Search ..... 417/550, 555.1

[56] References Cited

U.S. PATENT DOCUMENTS

| | | | |
|---|---|---|---|
| 3,907,461 | 9/1975 | Bouder | 417/63 |
| 4,120,614 | 10/1978 | Bouder | 417/63 |
| 5,127,804 | 7/1992 | Chappell | 417/231 |

*Primary Examiner*—Teresa Walberg
*Assistant Examiner*—Vinod D. Patel
*Attorney, Agent, or Firm*—Browdy and Neimark

[57] ABSTRACT

A floor pump consists of a pump seat, a pumping rod, a pivoting member, an air nozzle, and an air guiding hose. The pump seat is composed of a cylinder and a base. The cylinder is provided in the bottom end thereof with a cross through hole in communication with a chamber of the cylinder. The pumping rod is composed of a handle and a rod body which is inserted into the chamber of the pump seat and is connected at the bottom end thereof with a valve plug for forcing air into the cross through hole. The pivoting member is provided with a shaft tube which is received in the cross through hole and is connected at one end thereof with a tube head in such a manner that other end of the shaft tube is jutted out of the cross through hole, and that the other end of the shaft tube is connected with a locating member. The shaft tube is provided in the periphery thereof with two leakproof rings for preventing the leak of air that has entered the cross through hole. Located between the leakproof rings is an air admitting hole via which air is admitted to the shaft tube. The air is then allowed to flow into the tube head via an air duct. The tube head is provided therein with a check valve to avert the reverse flow of air. The air nozzle has a head which is provided with an injector and is engageable with the inflation valve of an inflatable object. The air guiding hose is connected with the tube head of the pivoting member and the head of the air nozzle and is intended to guide the air to flow from the air duct of the pivoting member to the air nozzle.

8 Claims, 4 Drawing Sheets

FLOOR PUMP

FIELD OF THE INVENTION

The present invention relates generally to an air pumping device, and more particularly to a floor pump which is simple in construction and cost-effective.

BACKGROUND OF THE INVENTION

The conventional floor pump for use in inflating the bicycle tires is generally made of a metal material and is therefore heavy and expensive. Certain conventional floor pumps are made of a lightweight plastic material and are thus relatively cost-effective; nevertheless they are relatively complicated in construction as well as assembly. In addition, the conventional floor pumps of the plastic material are not resistant to heat that is generated in the midst of the pumping process. As a result, the heat-resistant materials are used in place of the plastic material. The floor pumps of the heat-resistant materials are more expensive than those which are made of the plastic material.

SUMMARY OF THE INVENTION

The primary objective of the present invention is therefore to provide a floor pump which is made of a plastic material and is simple in construction and cost-effective.

In keeping with the principle of the present invention, the foregoing objective of the present invention is attained by the floor pump consisting of a pump seat, a pumping rod, a rotating member, an air nozzle, and an air guiding hose. The pump seat is composed of a cylinder and a base. The cylinder is provided in the bottom end thereof with a cross through hole in communication with a chamber of the cylinder. The pumping rod is composed of a handle and a rod body which is inserted into the chamber of the pump seat and is connected at the bottom end thereof with a valve plug for forcing air into the cross through hole. The rotating member is of a tubular construction and is provided with a shaft tube which is received in the cross through hole and is connected at one end thereof with a tube head in such a manner that the other end of the shaft tube is jutted out of the cross through hole, and that the other end of the shaft tube is connected with a locating member. The shaft tube is provided in the periphery thereof with two leakproof rings for preventing the leak of air that has entered the cross through hole. Located between the two leakproof rings is an air admitting hole via which air is admitted to the interior of the shaft tube. The air is then allowed to flow into the tube head via an air duct. The tube head is provided therein with a check valve to avert the reverse flow of the air. The air nozzle has a head which is provided with an injector and is engageable with the inflation valve of an inflatable object. The air guiding hose is connected with the tube head of the rotating member and the head of the air nozzle and is intended to guide the air to flow from the air duct of the rotating member to the air nozzle.

When the floor pump is at work, the compressed air flows from the chamber into the cross through hole such that considerable heat is generated. The rotating member of the present invention is made of a heat-resistant material and is therefore capable of withstanding the heat.

The foregoing objective, features, functions, and advantages of the present invention will be more readily understood upon a thoughtful deliberation of the following detailed description of a preferred embodiment of the present invention with reference to the accompanying drawings.

DETAILED DESCRIPTION OF THE INVENTION

Figure 1:
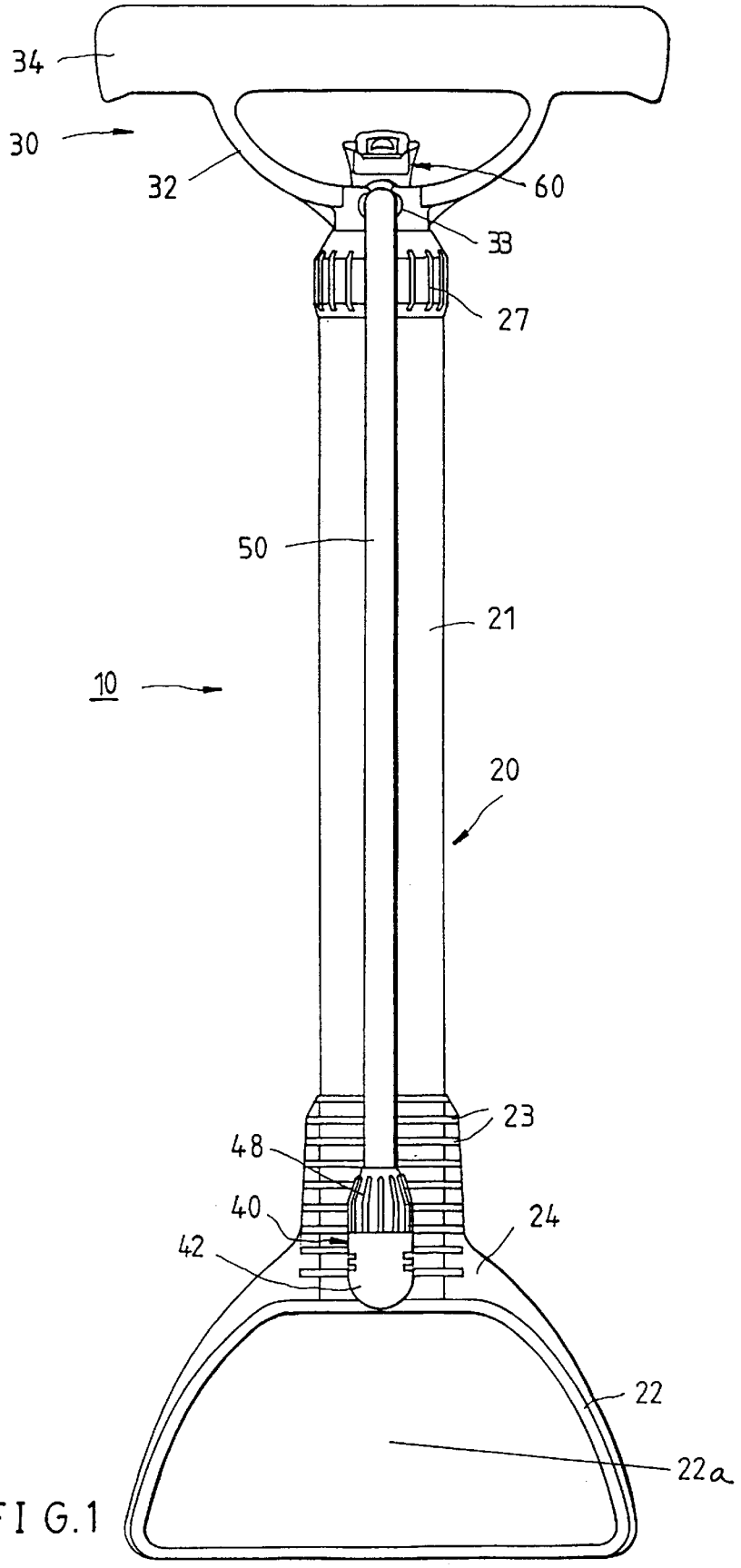
FIG. 1 is a front view of the preferred embodiment of the present invention not in use.

As shown in all drawings provided herewith, a floor pump 10 embodied in the present invention is composed of the component parts which are described hereinafter.

A pump seat 20 is made of a plastic material by injection molding and is composed of a cylinder 21 and a base 22 which is of a trapezoidal frame and is connected with the bottom end of the cylinder 21. The base 22 is pressed with the foot of a person through an opening 22*a* in the frame against a floor so as to secure the floor pump 10 at work. The cylinder 21 is provided in the periphery of the bottom end thereof with a plurality of partitions 23 located at the same level and at an interval. The cylinder 21 is further provided respectively in two sides thereof with a connection plate 24 extending to reach the base 22. The cylinder 21 is further provided at the bottom end thereof with a cross through hole 25. The cylinder 21 is still further provided therein with a chamber 211 which extends from the top end of the cylinder 21 to the proximity of the cross through hole 25. The chamber 211 is provided at the bottom thereof with a through hole 26 in communication with the cross through hole 25. The cylinder 21 is still further provided at the top end thereof with a perforated end collar 27 fastened therewith.

A pumping rod 30 is made of a plastic material by injection molding and is made up of a rod body 31, which is connected at the top end thereof with a semicircular support 32 having an arcuate recess facing upwards. The support 32 is provided at the center thereof (which is also the top end of the rod body 31) with an insertion slot 33. The support 32 is further provided at the top end thereof with a handle 34 which is fastened therewith. The rod body 31 is inserted into the chamber 211 of the pump seat 20 via the end collar 27 such that the bottom end of the rod body 31 is fastened with a valve seat 35, which has a body 351 provided with a short columnar portion 352 extending from the bottom of the body 351. The short columnar portion 352 is connected at the bottom end thereof with a block 353. The top of the body 351 urges the hole edge 271 of the bottom of the end collar 27. The pumping rod 30 can not be pulled out of the cylinder 21. A valve plug 36 is fitted over the short columnar portion 352 such that the periphery of the valve plug 36 is elastically attached to the wall of the chamber 211. The valve plug 36 is provided at the top thereof with two protruded rings 361, and at the bottom thereof with a plurality of protrusions 362 capable of attaching to the top of the block 353 of the valve plug 36. When the pumping rod 30 is moved downwards, the valve plug 36 is displaced upwards such that the bottom of the body 351 of the valve seat 35 is attached to the protrusions 362, and that the air located under the valve plug 36 is compressed before flowing into the cross through hole 25 via the through hole 26. When the pumping rod 30 is moved upwards, the valve plug 36 is displaced downwards. The atmospheric air is allowed into the place under the valve plug 36 via the protrusions 362.

A rotating member 40 is of a tubular construction and is composed of a shaft tube 41 and a tube head 42 which is connected with one end of the shaft tube 41 and is provided at the top side thereof with a threaded connection portion 43 and an air duct 44 extending from the outer end of the shaft tube 41 (another end of the tube head) through the top end of the threaded connection portion 43. The air duct 44 is provided with a funneled portion 441 corresponding in location to the tube head 42. The shaft tube 41 is provided in the center thereof with a small diametrical portion 411 which is in turn provided respectively in two sides thereof with a leakproof ring 412 and is further provided radially with an air admitting hole 413. The rotating member 40 causes the shaft tube 41 to be rotating in the cross through hole 25 of the pump seat 20. The tube head 42 is retained outside the cross through hole 25. The outer end of the shaft tube 41 is jutted out of another end of the cross through hole 25. The two leakproof rings 412 of the shaft tube 41 are located at two sides of the through hole 26 to prevent the leak of air which flows into the cross through hole 25 from the through hole 26, thereby allowing the air to flow into the air duct 44 from the air admitting hole 413. A locating member 45 of a caplike construction is fastened with the outer end of the shaft tube 41. The rotating member 40 is prevented from displacing aside axially and from being pulled out. The locating member 45 is provided therein with a leakproof ring 451 to prevent the leak of air contained in the air duct 44. A spherical body 46 is received in the threaded connection portion 43 such that the spherical body 46 is capable of moving downward to join with the funneled portion 441 to obstruct the air duct 44. A connection member 47 is provided with a blocking portion 472 having a leakproof ring 471, a plurality of radiate ribs 473, and an insertion portion 474 extending from the top of the blocking portion 472. An air hole 475 is extended through the axes of the blocking portion 472 and the insertion portion 474. The blocking portion 472 is plugged into the threaded connection portion 43. The funneled portion 441, the spherical body 46 and the connection member 47 form together a check valve which allows the air to flow from the air duct 44 to the air hole 475 of the connection member 47. The threaded connection portion 43 is engaged with a first sleeve 48.

An air guiding hose 50 is fastened at one end thereof with the insertion portion 474 of the connection member 47 via the first sleeve 48 such that the hose 50 is in communication with the air hole 475 of the connection member 47. The end of the hose 50 is confined by the first sleeve 48, thanks to the bracing of the insertion portion 474 of the connection member 47.

An air nozzle head 60 has a cylindrical head 61 which is provided therein with a receiving cell 62 and in the periphery thereof with a fastening portion 63 having an insertion portion 64 extending therefrom. An air hole 65 is extended from the insertion portion 64 through the receiving cell 62. An injector 66 and a soft cylinder 661 are received in the receiving cell 65. A wrench 67 is fastened pivotally with the head 61 for pressing the injector 66 and the soft cylinder 661 in the inflating process such that the soft cylinder 661 catches securely the air valve of an inflatable object. A turning head 68 is received in a storage space 671 of the wrench 67 and can be taken out to be connected the exit end of the receiving cell 62 of the head 61. A second sleeve 69 is fastened with the fastening portion 63. The another end of the hose 50 is fastened with the insertion portion 64 via the second sleeve 69 such that the hose 50 is in communication with the air hole 65 of the head 61.

In operation, the air in the chamber 211 is compressed by the valve plug 35 and is then forced through the through hole 26, the air admitting hole 413 and the air duct 44 of the rotating member 40 in which high heat is generated. The rotating member 40 is made of a nylon material which is reinforced by fiber and is relatively resistant to heat. In addition, the partitions 23 located at the bottom of the cylinder 21 serve to provide a cooling effect. The other component parts of the floor pump 10 of the present invention are made of an ordinary material, such as PP.

Figure 2:
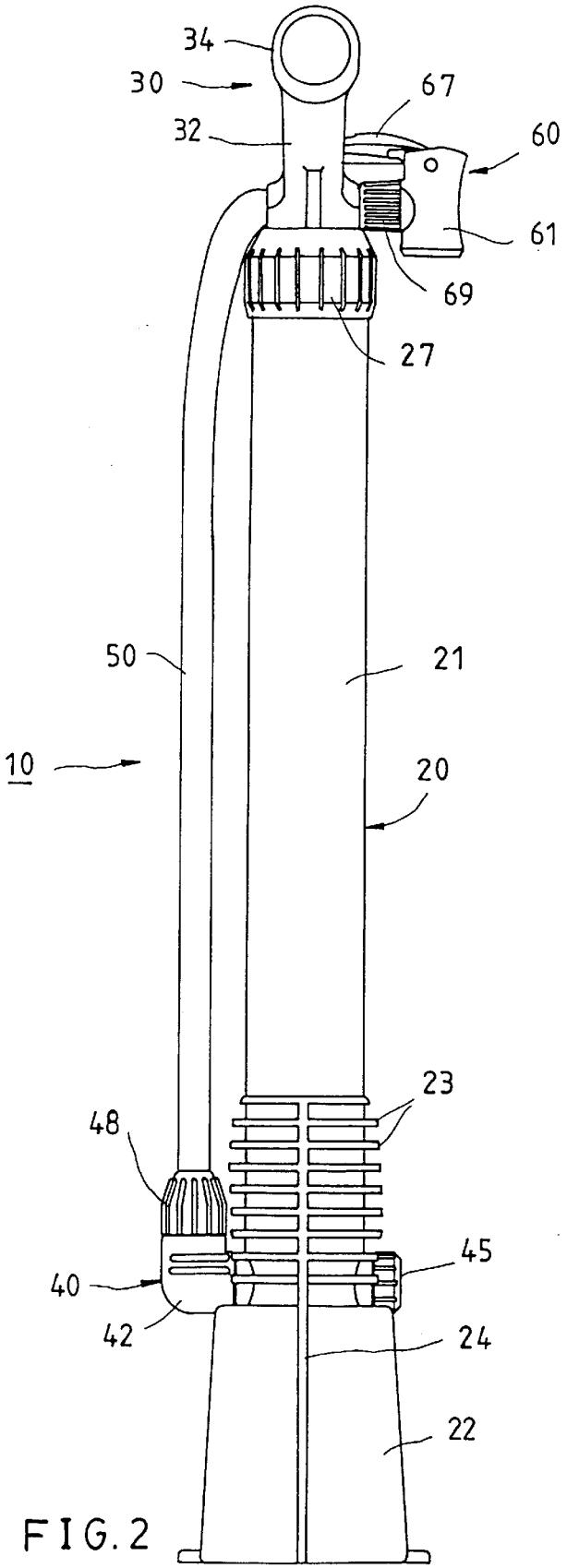
FIG. 2 shows a side view of the preferred embodiment of the present invention not in use.
Figure 3:
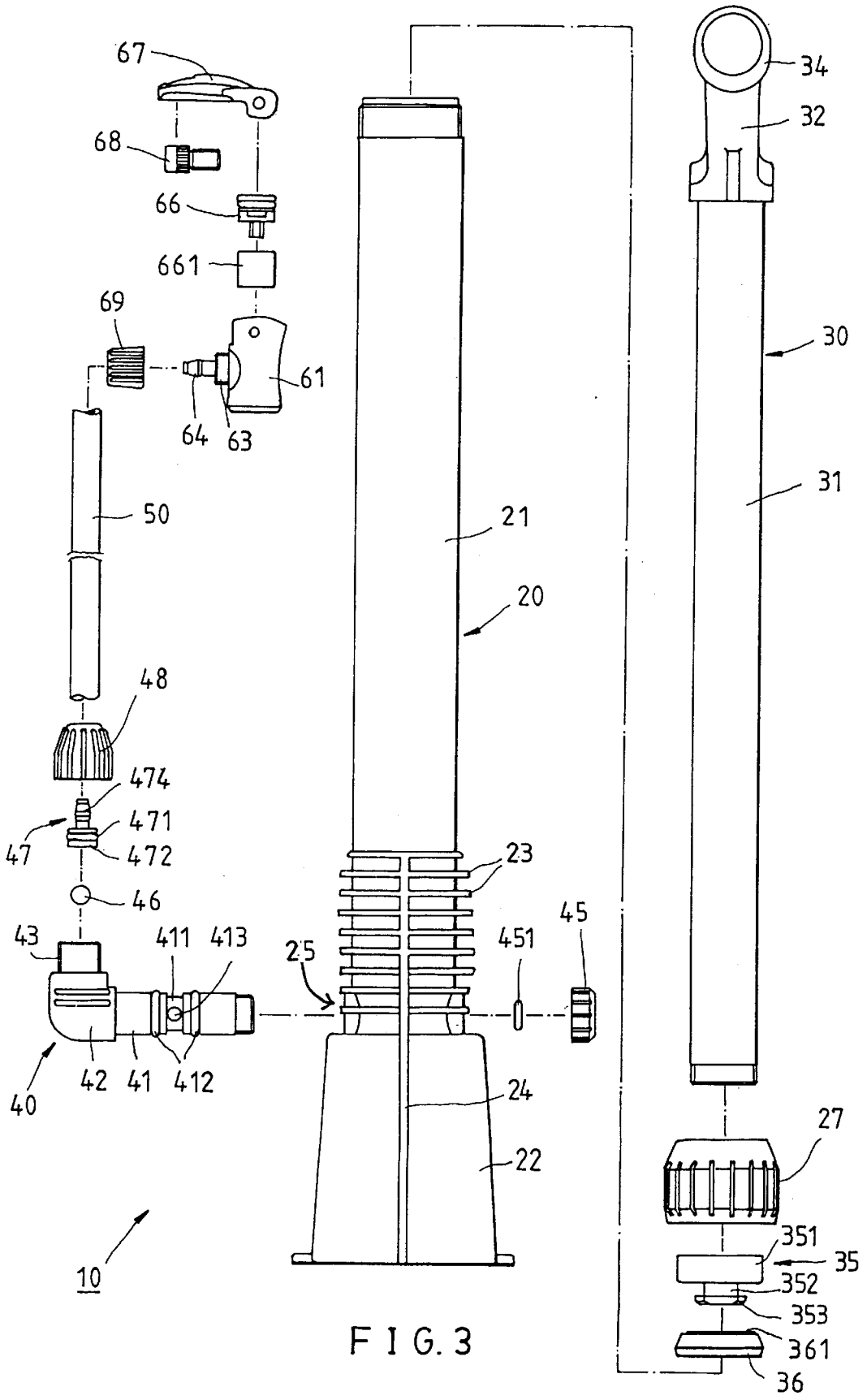
FIG. 3 shows an exploded view of the preferred embodiment of the present invention.
Figure 4:
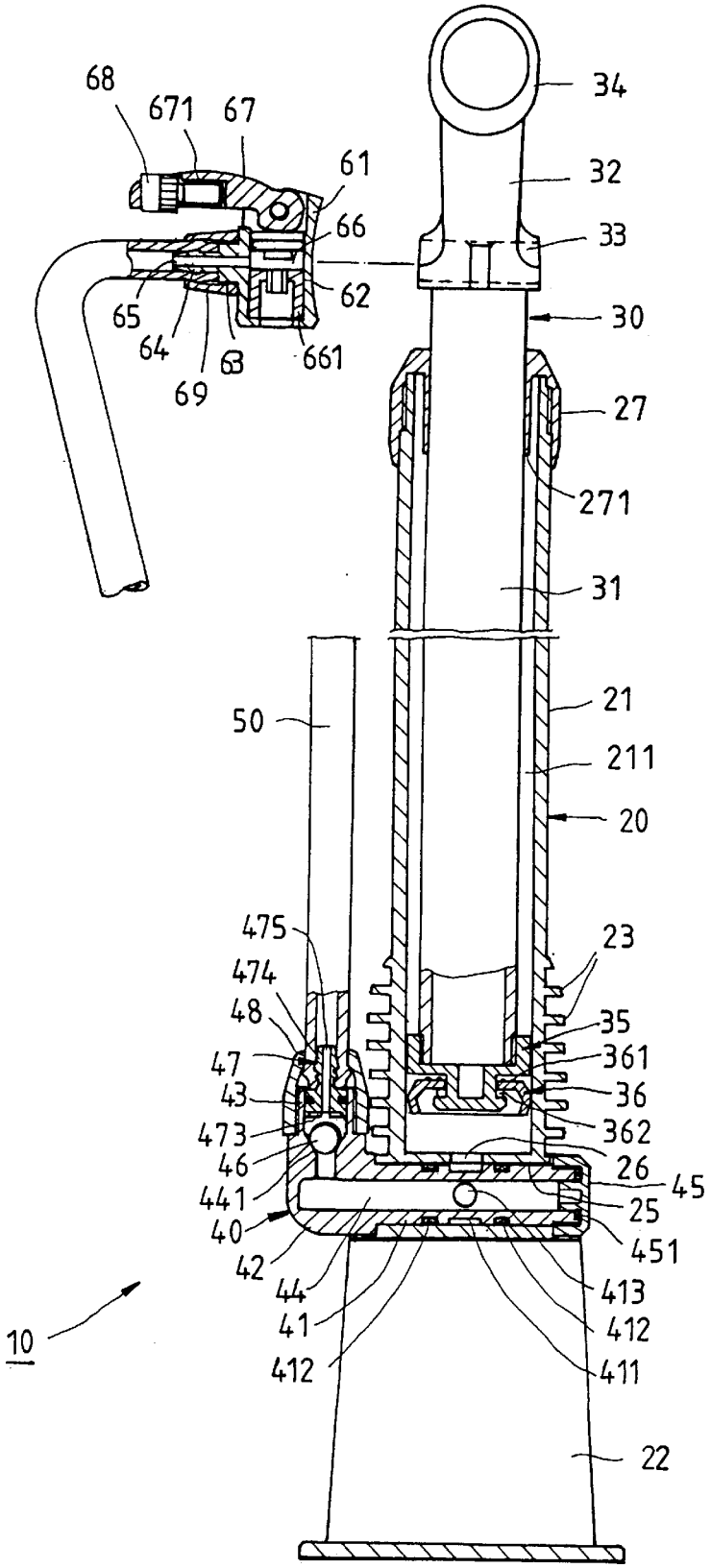
FIG. 4 shows a partial side sectional view of the preferred embodiment of the present invention.

When the floor pump 10 is not in use, the pumping rod 30 can be pressed to the ultimate bottom. Thereafter, the air nozzle head 60 is put through the underside of the handle 34. The hose 50 is received in the insertion slot 33 so as to locate the air nozzle head 60 at the top end of the rod body 31, as shown in FIGS. 1 and 2.

What is claimed is:

1. A floor pump comprising:

a pump seat having a cylinder extending into a chamber, a base connected with a bottom end of said cylinder, and a cross through hole located at the bottom end of said cylinder at an angle to an axis of the pump seat and in communication with said chamber;

a perforated end collar fastened with a top end of said cylinder;

a pumping rod having a rod body inserted into said chamber via said end collar, and a handle connected with a top end of said rod body and located outside chamber;

a valve seat fastened with a bottom end of said rod body such that movement of a top side of said valve seat is limited by a bottom side of said end collar;

a valve plug fastened with a bottom side of said valve seat;

a rotating member having a shaft tube rotatably engaged in said cross through hole; one end of said shaft tube projecting out of said cross through hole, said one end provided with threads; a tube head connected with another end of said shaft tube and located outside said cross through hole; an air duct extending from said one end of said shaft tube to said tube head; and an air admitting hole extending from a periphery of said shaft tube to said air duct;

two leakproof rings engaged on opposite sides of said air admitting hole to prevent leakage of air entering from said chamber into said cross through hole to the atmosphere;

a locating member threadedly engaged with said one end of said shaft tube of said pivoting member;

a check valve fastened with said tube head;

an air nozzle head having a head, a receiving cell located in said head, an injector received in said receiving cell, and wrench fastened with one end of said head for pressing said injector and said soft cylinder; and a flexible air guiding hose connected at one end thereof with said tube head of said rotating member, and at other end thereof with said head of said air nozzle head, to guide air from said air duct of said pivoting member to said receiving cell of said air nozzle head.

2. The floor pump as defined in claim 1, wherein said air duct of said rotating member is provided with a funneled portion corresponding in location to said tube head; a spherical body being received in said tube head such that said spherical body is capable of attaching to said funneled portion to obstruct said air duct; a connection member having a blocking portion fitted into a leakproof ring for plugging an exit end of said air duct, said blocking portion provided with a plurality of ribs and an insertion portion engaged with said air guiding hose, an air hole extending through said insertion portion and said blocking portion, said funneled portion, said spherical body and said connection member forming together a check valve.

3. The floor pump as defined in claim 1, wherein said wrench of said air nozzle head is provided with a storage space for a turning head.

4. The floor pump as defined in claim 1, wherein said cylinder is provided at a bottom thereof with a plurality of partitions, and at two sides thereof with a connection plate extending to reach said base.

5. The floor pump as defined in claim 1, wherein said rod body of said pumping rod is provided at a top end thereof with an insertion slot and a support extending upwards; wherein said handle is located across a top end of said support; and wherein said air nozzle head is located in said insertion slot via an underside of said handle and by means of said air guiding hose.

6. The floor pump as defined in claim 1, wherein the cross through hole is substantially perpendicular to an axis of the pump seat.

7. The floor pump as defined in claim 1, wherein the base is formed by a trapezoidal frame having an opening to permit a user to press the floor pump against a floor.

8. The floor pump as defined in claim 1, wherein a diameter of said rotating member is smaller at a center portion thereof than that at the end portions of the rotating member and a wherein said admitting hole is located in said center portion.

* * * * *

US006116873C1

(12) REEXAMINATION CERTIFICATE (4681st)

United States Patent

Wang

(10) Number: US 6,116,873 C1

(45) Certificate Issued: Dec. 10, 2002

(54) FLOOR PUMP

(75) Inventor: Lopin Wang, 16F-2, No. 17, Lane 52, Sec. 3, Je-He Road, Taichung (TW)

(73) Assignee: Lopin Wang, Taichung (TW)

Reexamination Request:
No. 90/006,238, Mar. 5, 2002

Reexamination Certificate for:

| | |
|---|---|
| Patent No.: | **6,116,873** |
| Issued: | **Sep. 12, 2000** |
| Appl. No.: | **09/139,746** |
| Filed: | **Aug. 25, 1998 09/139,746** |

(30) Foreign Application Priority Data

Sep. 1, 1997 (TW) ..... 86214909

(51) Int. Cl.[7] ..... F04B 39/10; F04B 53/12

(52) U.S. Cl. ..... 417/550

(58) Field of Search ..... 917/550, 555.1

(56) References Cited

U.S. PATENT DOCUMENTS

| | | | |
|---|---|---|---|
| 515,474 | A | 2/1894 | Holt |
| 587,347 | A | 8/1897 | Waite |
| 624,917 | A | 5/1899 | Feeny |
| 634,961 | A | 10/1899 | Smith |
| 670,811 | A | 3/1901 | Phelps |
| 695,199 | A | 3/1902 | Eddy |
| 799,786 | A | 9/1905 | Freel |
| 817,538 | A | 4/1906 | Wixon |
| 904,329 | A | 11/1908 | Hohman |
| 1,381,115 | A | 6/1921 | Gassenhuber |
| 1,424,928 | A | 8/1922 | McClelland |
| 1,522,370 | A | 1/1925 | Jenney |
| 1,623,647 | A | 4/1927 | Wepplo |
| 1,719,902 | A | 7/1929 | Reaney |
| 1,737,534 | A | 11/1929 | Davis |
| 1,854,797 | A | 4/1932 | Kirkpatrick |
| 2,016,113 | A | 10/1935 | Lambert et al. |
| 2,237,559 | A | 4/1941 | Jenne |
| 2,423,745 | A | 7/1947 | Wolfram |
| 2,450,295 | A | 9/1948 | Parker et al. |
| 2,459,716 | A | 1/1949 | Nickelsen et al. |
| 2,473,120 | A | 6/1949 | Wolfram |

(List continued on next page.)

OTHER PUBLICATIONS

Plastic Molding Technique, D.A. Dearle, ©1970, cover page, © and contents page, and pp. 206 & 207.

SPI Plastics Engineering Handbook of the Society of the Plastics Industry, Inc., 5th ed., Michael L. Berins, ©1991, cover page, © page, and pp. 319, 324 & 325.

*Primary Examiner*—Charles G Freay

(57) ABSTRACT

A floor pump consists of a pump seat, a pumping rod, a pivoting member, an air nozzle, and an air guiding hose. The pump seat is composed of a cylinder and a base. The cylinder is provided in the bottom end thereof with a cross. through hole in communication with a chamber of the cylinder. The pumping rod is composed of a handle and a rod body which is inserted into the chamber of the pump seat and is connected at the bottom end thereof with a valve plug for forcing air into the cross through hole. The pivoting member is provided with a shaft tube which is received in the cross through hole and is connected at one end thereof with a tube head in such a manner that other end of the shaft tube is jutted out of the cross through hole, and that the other end of the shaft tube is connected with a locating member. The shaft tube is provided in the periphery thereof with two leakproof rings for preventing the leak of air that has entered the cross through hole. Located between the leakproof rings is an air admitting hole via which air is admitted to the shaft tube. The air is then allowed to flow into the tube head via an air duct. The tube head is provided therein with a check valve to avert the reverse flow of air. The air nozzle has a head which is provided with an injector and is engagable with the inflation valve of an inflatable object. The air guiding hose is connected with the tube head of the pivoting member and the head of the air nozzle and is intended to guide the air to flow from the air duct of the pivoting member to the air nozzle.

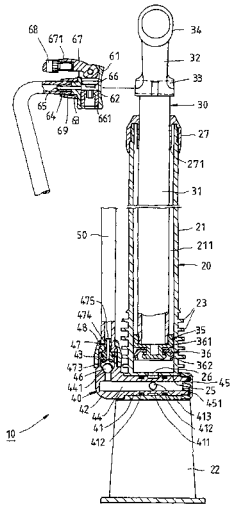

U.S. PATENT DOCUMENTS

| | | | |
|---|---|---|---|
| 2,577,654 | A | 12/1951 | Gates |
| 2,828,050 | A | 3/1958 | Engelder |
| 2,970,399 | A | 2/1961 | Frohlich et al. |
| 3,008,686 | A | 11/1961 | Becker |
| 3,239,192 | A | 3/1966 | Totten |
| 3,452,647 | A | 7/1969 | Herrell |
| 3,592,439 | A | 7/1971 | Ritchie, Jr. |
| 3,596,799 | A | 8/1971 | Fairchild et al. |
| 3,597,780 | A | 8/1971 | Coyle |
| 3,718,312 | A | 2/1973 | Payne |
| 3,910,465 | A | 10/1975 | Loeffler |
| 3,926,205 | A | 12/1975 | Gourlet |
| 4,017,057 | A | 4/1977 | Strybel |
| 4,063,708 | A | 12/1977 | Smith |
| 4,276,898 | A | 7/1981 | Ross |
| 4,323,268 | A | 4/1982 | Wilson |
| 4,328,948 | A | 5/1982 | Pearl, II |
| 4,338,793 | A | 7/1982 | O'Hern, Jr. |
| 4,449,738 | A | 5/1984 | Hotger |
| 4,475,748 | A | 10/1984 | Ekman |
| 4,508,490 | A | 4/1985 | Ramirez et al. |
| 4,569,275 | A | 2/1986 | Brunet |
| 4,976,372 | A | 12/1990 | Rogers, Jr. |
| 5,026,261 | A | 6/1991 | Jou |
| 5,054,514 | A | 10/1991 | Valdes Marin |
| 5,165,876 | A | 11/1992 | Wang |
| 5,180,283 | A | 1/1993 | Vickery, III |
| 5,316,055 | A | 5/1994 | Brimmer |
| 5,379,796 | A | 1/1995 | Wang |
| 5,390,899 | A | 2/1995 | Perez |
| 5,443,370 | A | 8/1995 | Wang |
| 5,449,278 | A | 9/1995 | Lin |
| 5,494,411 | A | 2/1996 | Chuang |
| 5,531,575 | A | 7/1996 | Lin |
| 5,533,436 | A | 7/1996 | Chuang |
| 5,538,031 | A | 7/1996 | Brence et al. |
| 5,551,848 | A | 9/1996 | Chuang et al. |
| 5,607,189 | A | 3/1997 | Howeth |
| 5,624,242 | A | 4/1997 | Wu |
| 5,626,072 | A | 5/1997 | Mirand et al. |
| 5,628,350 | A | 5/1997 | Gibb |
| 5,636,877 | A | 6/1997 | Purvis et al. |
| 5,638,865 | A | 6/1997 | Wu |
| 5,645,100 | A | 7/1997 | Chuang et al. |
| 5,655,890 | A | 8/1997 | Liao |
| 5,665,908 | A | 9/1997 | Burkey et al. |
| 5,666,990 | A | 9/1997 | Wu |
| 5,681,154 | A | 10/1997 | Yang |
| 5,683,234 | A | 11/1997 | Chuang et al. |
| 5,690,016 | A | 11/1997 | Hwang |
| 5,713,723 | A | 2/1998 | Hathaway |
| 5,749,392 | A | 5/1998 | Glotin |
| 5,762,095 | A | 6/1998 | Gapinski et al. |
| 5,779,457 | A | 7/1998 | Chuang et al. |
| 5,785,076 | A | 7/1998 | You |
| 5,819,781 | A | 10/1998 | Wu |
| 5,873,705 | A | 2/1999 | Chen |
| 5,898,965 | A | 5/1999 | Chuang |
| 5,902,097 | A | 5/1999 | Wu |
| 5,911,520 | A | 6/1999 | Kenney |
| 5,921,269 | A | 7/1999 | Wu |
| 5,947,706 | A | 9/1999 | Gapinski ..... 417/437 |
| 5,960,815 | A | 10/1999 | Wang |
| 5,964,577 | A | 10/1999 | Chuang ..... 417/63 |
| 5,975,109 | A | 11/1999 | Wu |
| 5,983,920 | A | 11/1999 | Gapinski et al. |
| 6,017,196 | A | 1/2000 | Wu |
| 6,027,316 | A | 2/2000 | Wang |
| 6,027,319 | A | 2/2000 | Winefordner et al. |
| 6,044,508 | A | 4/2000 | Chuang |
| 6,050,791 | A | 4/2000 | Wu |
| 6,059,548 | A | 5/2000 | Campbell et al. ..... 417/555.1 |
| 6,065,947 | A | 5/2000 | Wu |
| 6,070,855 | A | 6/2000 | Chuang et al. |
| 6,073,645 | A | 6/2000 | Wu |
| 6,076,544 | A | 6/2000 | Pierce |
| 6,079,954 | A | 6/2000 | Kownacki et al. ..... 417/63 |
| 6,102,063 | A | 8/2000 | Pierce et al. |
| 6,105,600 | A | 8/2000 | Wang |
| 6,105,601 | A | 8/2000 | Wang |
| 6,120,265 | A | 9/2000 | Wu |
| 6,135,733 | A | 10/2000 | Wu |
| 6,146,116 | A | 11/2000 | Wu et al. |
| 6,164,938 | A | 12/2000 | Chuang |
| 6,190,142 | B1 | 2/2001 | Wu |
| 6,196,807 | B1 | 3/2001 | Wu |
| 6,202,714 | B1 | 3/2001 | Wang |
| 6,220,273 | B1 | 4/2001 | Wu |
| 6,220,274 | B1 | 4/2001 | Wang |
| 6,220,836 | B1 | 4/2001 | Wu |
| 6,250,205 | B1 | 6/2001 | Chuang |
| 6,257,849 | B1 | 7/2001 | Wu |
| 6,260,572 | B1 | 7/2001 | Wu |
| 6,276,391 | B1 | 8/2001 | Wu |
| 6,276,405 | B1 | 8/2001 | Wang |
| 6,289,920 | B1 | 9/2001 | Wang |
| 6,290,476 | B1 | 9/2001 | Wu |
| 6,318,969 | B1 | 11/2001 | Wang |
| 6,325,601 | B2 | 12/2001 | Wu |
| 6,328,057 | B1 | 12/2001 | Wang |

REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1–8 is confirmed.

* * * * *